US005710569A

United States Patent [19]

Oh et al.

[11] Patent Number: 5,710,569

[45] Date of Patent: Jan. 20, 1998

[54] ANTENNA SYSTEM HAVING A CHOKE REFLECTOR FOR MINIMIZING SIDEWARD RADIATION

[75] Inventors: Jung Kun Oh; Yong Hee Lee; Jae Ho Lee; Jung Sik Kim; Byung Ill Oh, all of Kyunggi-do, Rep. of Korea

[73] Assignee: Ace Antenna Corporation, Kyunggi-do, Rep. of Korea

[21] Appl. No.: 428,012

[22] Filed: Apr. 25, 1995

[30] Foreign Application Priority Data

Mar. 3, 1995 [KR] Rep. of Korea ..... 95-4409

[51] Int. Cl.[6] ..... H01Q 21/00

[52] U.S. Cl. ..... 343/817; 343/816; 343/818

[58] Field of Search ..... 343/817, 810, 343/813, 815, 818, 819, 814, 816; H01Q 21/00

[56] References Cited

U.S. PATENT DOCUMENTS

| | | | |
|---|---|---|---|
| 5,111,214 | 5/1992 | Kumpfbeck et al. | 343/817 |
| 5,229,783 | 7/1993 | Tilston et al. | 343/818 |
| 5,440,318 | 8/1995 | Butland et al. | 343/814 |
| 5,469,181 | 11/1995 | Yarsunas | 343/815 |

FOREIGN PATENT DOCUMENTS

| | | | |
|---|---|---|---|
| 45254 | 2/1982 | European Pat. Off. | 343/817 |
| 839490 | 6/1960 | United Kingdom | 343/818 |

*Primary Examiner*—Hoanganh T. Le

*Attorney, Agent, or Firm*—Jacobson, Price, Holman & Stern, PLLC

[57] ABSTRACT

A antenna system of the present invention comprises a radiator for radiating a radio frequency, which is converted from electric power, and which has a impedance matching unit and a power divider; a first reflector for reflecting and filtering the radio frequency; and at least one second reflector for filtering the radio frequency radiated in the sideward direction of the antenna system, which is vertically attached to the first reflector, and is able to be moved in a horizontal direction.

3 Claims, 5 Drawing Sheets

ANTENNA SYSTEM HAVING A CHOKE REFLECTOR FOR MINIMIZING SIDEWARD RADIATION

BACKGROUND OF THE INVENTION

1. Field of the Invention

The present invention relates to an antenna system having a choke reflector, which is attached to a folded reflector, in order to prevent radio frequency signals from radiating in a side direction.

2. Description of the Prior Art

In general, since a base station, having communication antennas, is considerably restricted by topographic circumstances, the distance between antennas in the same base station is too short. Accordingly, the antennas have an influence on each adjacent antenna.

Also, since a conventional directivity antenna consists of a plane sheet reflector, the radiation from the reflector goes very much in a sideward direction. This sideward radiation causes interferences with adjacent antennas and result in call losses.

Furthermore, the side end of the reflector must be modified for changing the horizontal beamwidth and front-to-back ratio, which are the characteristics of antennas. In particular, the reflector of the antenna must be enlarged for the improvement of the front-to-back ratio.

However, conventional antennas, having wide reflectors, are influenced by wind pressure.

SUMMARY OF THE INVENTION

Therefore, the object of the present invention is to provide an antenna system capable of preventing the radiational of a radio frequency in a sideward direction with a folded reflector, and filtering the sideward radiation by using a choke reflector, thereby the radiation in a sideward direction decreases so that mutual interferences with adjacent antennas in the same base station are decreased, that the weight of wind pressure is decreased by means of a miniature antenna which has a choke reflector, and that the characteristics, the front-to-back ratio and 3 dB beamwidth, of the antennas are optimized by controlling the position and the number of choke reflectors.

In accordance with the present invention, this object can be accomplished by providing an antenna system comprising: a radiating means for radiating a radio frequency, which is converted into electric power, and which has an impedance matching unit and a power divider; a first reflecting means for reflecting and filtering said radio frequency; and at least one second filtering means for reflecting said radio frequency into electric power, and which has an impedance matching unit and a power divider; a first reflecting means for reflecting and filtering said radio frequency; and at least one second filtering means for reflecting said radio frequency radiated sidewards toward the direction of said antenna system, which is vertically attached to said first reflecting means and is able to be moved in a horizontal direction.

BRIEF DESCRIPTION OF THE DRAWINGS

In the annexed drawing

DETAILED DESCRIPTION OF THE INVENTION

Hereinafter, a preferred embodiment of the invention will be described in detail with reference to the drawings.

Figure 1:
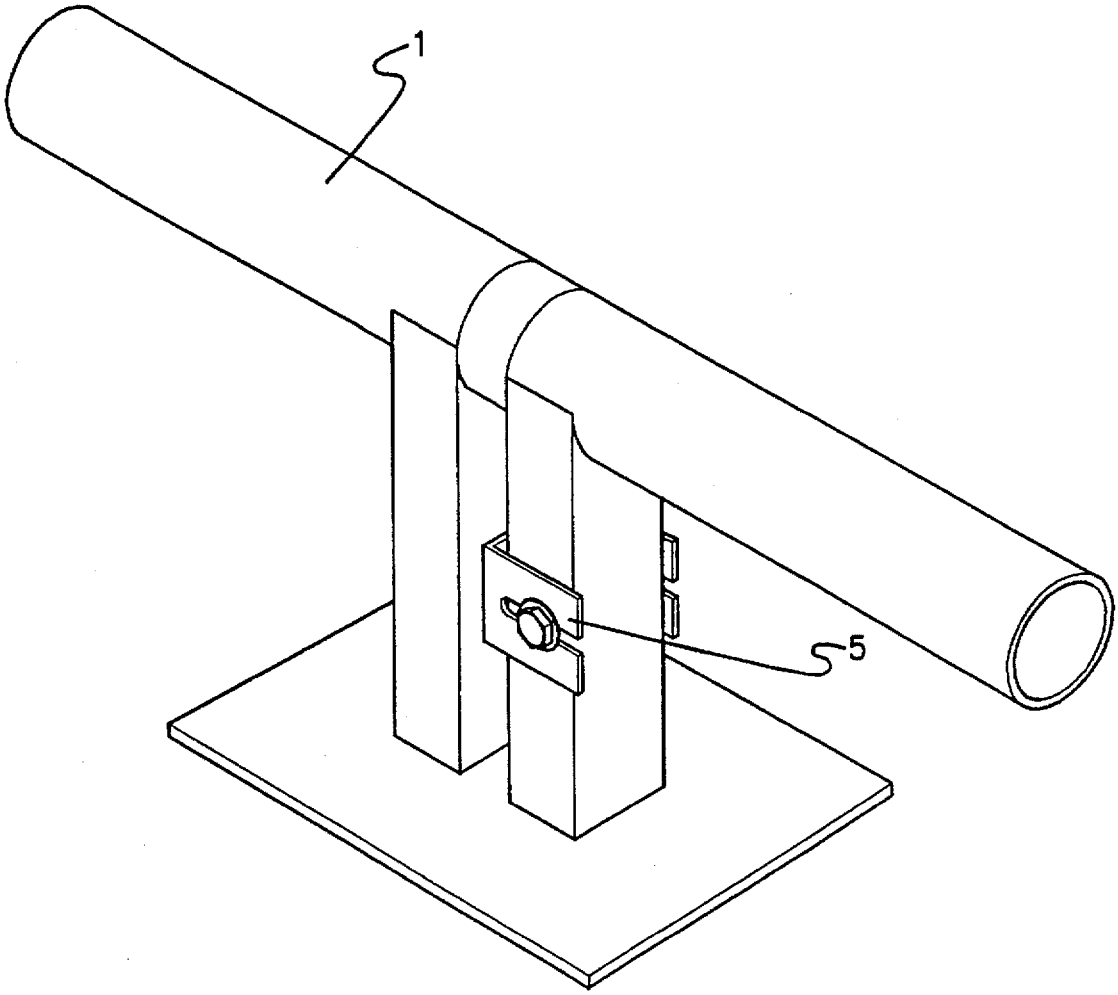
FIG. 1 is a perspective view showing a structure of a coaxial dipole.

Referring to FIG. 1, a coaxial dipole 1 is a half wavelength long and two supporters are vertically formed in the center of the coaxial dipole 1 to a predetermined length. Also, a fitting plate is formed in the lower end of the two supporters which are fixed to the reflector of a antenna.

An impedance matching unit 5 attached in the center of the supporter is used for controlling impedance in response to the frequency which is now used in the antenna. That is, since a variety of elements are coupled to the coaxial dipole 1, it is necessary to control impedance variation. Then, the impedance matching unit 5 is movable in a right or left direction to match impedance.

Figure 2A:
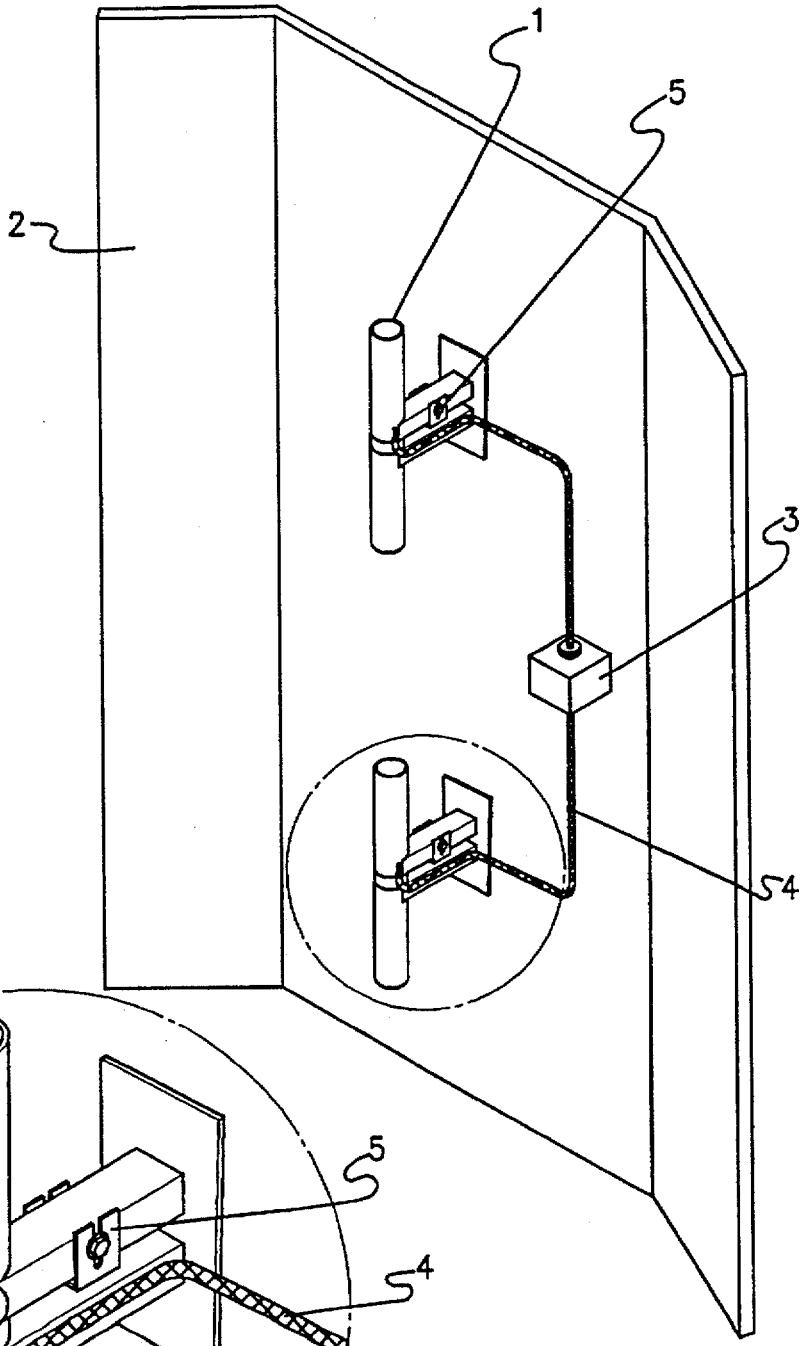
FIG. 2 is a perspective view showing the structure of an antenna without a choke reflector according to the present invention.
Figure 2B:
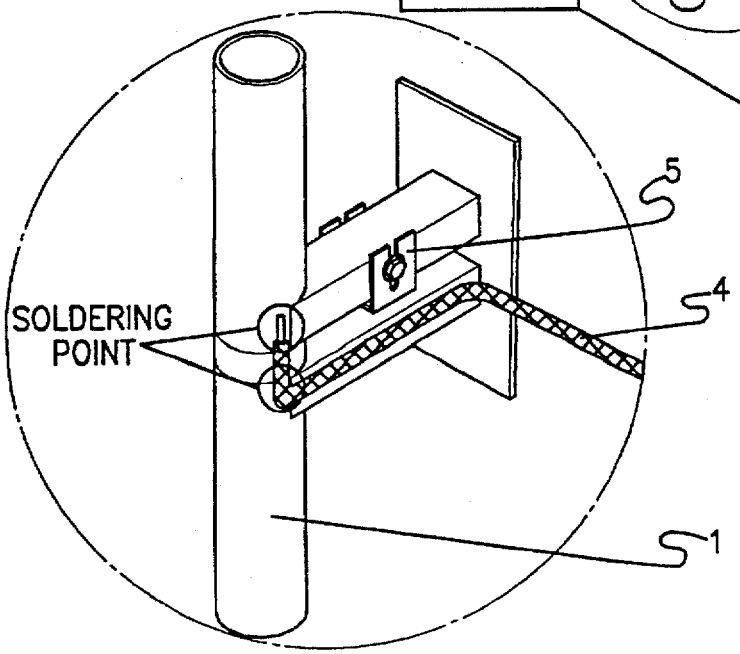

As shown in FIG. 2 the coaxial dipole 1, the impedance matching unit 5, and a n-port power divider 3 (n is a natural number) are fixed to a folded reflector 2.

Both ends of the folded reflector 2 which has influence on the characteristics of the antenna, are folded at a predetermined portion and angle in order to prevent sideward radiation. In the preferred embodiment of the present invention, the two ends of the folded reflector 2 are folded to an angle of 45°~90°, being appropriate for the characteristics of the antenna. The folded reflector 2 may also be a fitting type or a variable type.

A number of the coaxial dipoles are uniformally arranged on the center of the folded reflector 2. The more coaxial dipoles there are, the more gain of the antenna that can be achieved.

Also, the n-port power divider 3 is attached on the folded reflector 2 to provide the coaxial dipole 1 with power.

One end of a coaxial feeder 4, having a uniform phase, is connected to the center of the coaxial dipole 1 by soldering and the other end of the coaxial feeder 4 is connected to the n-port power divider 3.

Figure 3:
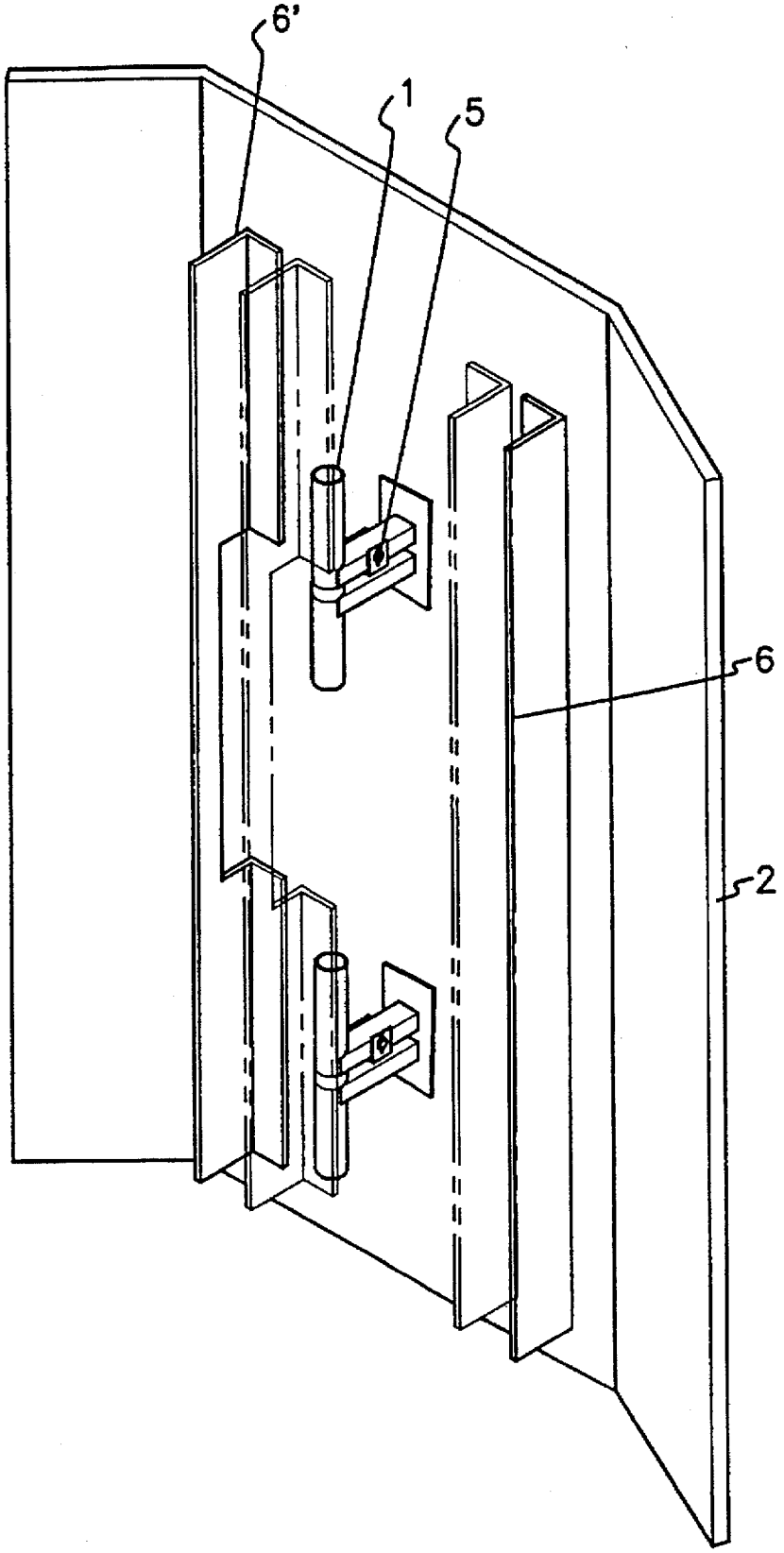
FIG. 3 is a perspective view showing a structure of which has a choke reflector according to the present invention.

FIG. 3 shows choke reflectors 6 and 6' attached to the folded reflector 2 in FIG. 2.

The choke reflectors 6 and 6' are formed on a metal plate and vertically attached to a portion between the coaxial dipole 1 and the folded portion of the choke reflector 2, in order that the two sides of the coaxial dipole 1 are shielded by the choke reflectors 6 and 6'. Also, the position of the choke reflectors 6 and 6' can be movable in a horizontal direction to control the characteristics of the antenna. If necessary, several choke reflectors can be set on the folded reflector 2.

The electric power transmitted from a transmitter is converted into radio waves and the radio waves are propagated over the air. Then, the radio waves are reflected by the choke reflector 6 and 6'. However, some of the radio waves pass through the choke reflector 6 and 6'. At this time, some of the radio waves, which pass through the choke reflector 6 and 6', are reflected over again by the folded portion of the folded reflector 2, and the rest are propagated over the air. If a number of the choke reflectors are formed on the folded reflector, the sideward radiation of the radio waves can be minimized. Also, 3 dB beamwidth, which is one of the characteristics of antenna, can be controlled by controlling the amount of the radiation in a forward direction with the choke reflector 6 and 6'. This effect can also be obtained by controlling the position of the choke reflectors 6 and 6'.

Figure 4:
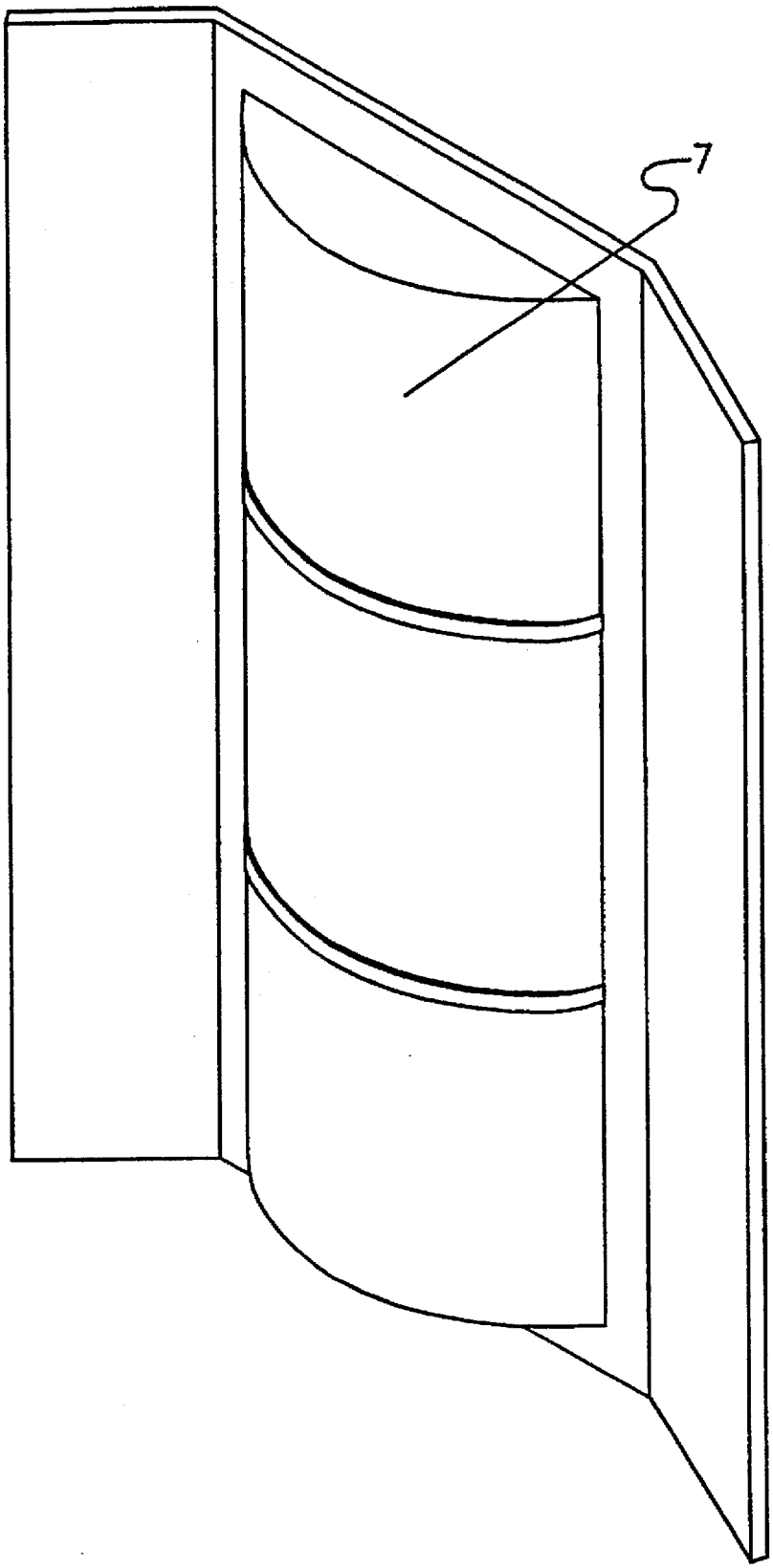
FIG. 4 is a perspective view showing the structure of a choke reflector antenna with a snow-proof cover according to the present invention.

FIG. 4 shows a snowy-proof cover 7, which protects the coaxial dipole 1, the coaxial feeder 4 and the feeding point from external conditions such as rain and snow.

Figure 5:
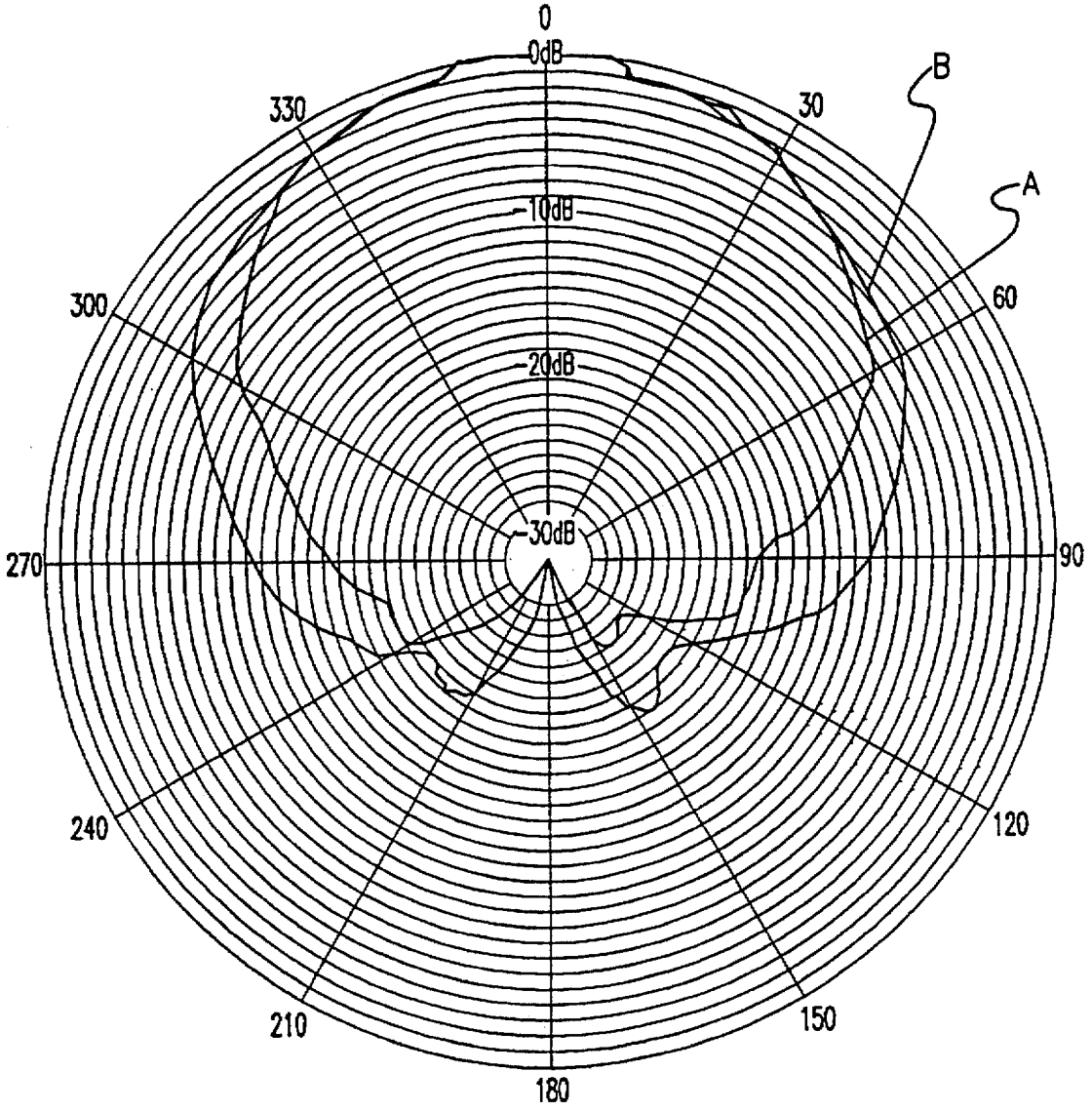
FIG. 5 is a characteristic view showing horizontal radiation patterns of a vertical polarized wave of a choke reflector antenna according to the present invention.

FIG. 5 shows the radiation pattern of the present invention and the radiation pattern of a conventional plane reflector antenna.

In FIG. 5, a numeral A is the horizontal radiation pattern of the present invention and a numeral B is the horizontal radiation pattern of a conventional reflector antenna. As shown in FIG. 5, pattern A is diminished in comparison with pattern B. For example, −5 dB and −7 dB attenuation area are shown at 270° and 90°, respectively. As described above, since the radiation is remarkably decreased in the sideward direction by the choke reflector, reflecting side radiation, the interference with adjacent antennas is considerably decreased. Therefore, the present invention has an effect on the antenna system in that an excellent communication quality, a sufficient insurance of a communication area, a reduction of wind pressure, according to diminution of the antenna's size, the improved characteristics of the antenna, such as the 3 dB beamwidth and the front-to-back ratio can be obtained by controlling the number of and the position of the choke reflectors.

What is claimed is:

1. An antenna system comprising:

a radiating means for radiating a radio frequency, which is converted from electric power, and which has an impedance matching unit and a power divider;

a first reflecting means for reflecting and filtering said radio frequency; and at least one second reflecting means for filtering said radio frequency radiated in a sideward direction of said antenna system, which is vertically attached to said first reflecting means, and is able to be moved in a horizontal direction.

2. An antenna system in accordance with claim 1, wherein said antenna system further comprises a snow-proof cover to protect internal elements from external conditions.

3. An antenna system in accordance with claim 1, wherein said first reflecting means is folded to an angle of 45° to 90°.

* * * * *